US011261594B2

(12) United States Patent
Boeltl

(10) Patent No.: US 11,261,594 B2
(45) Date of Patent: Mar. 1, 2022

(54) LIGATURE RESISTANT STRAINER AND DRAIN ASSEMBLY

(71) Applicant: Acorn Engineering Company, City Of Industry, CA (US)

(72) Inventor: Darryl M. Boeltl, Whittier, CA (US)

(73) Assignee: Acorn Engineering Company, City of Industry, CA (US)

( * ) Notice: Subject to any disclaimer, the term of this patent is extended or adjusted under 35 U.S.C. 154(b) by 0 days.

(21) Appl. No.: 17/012,935

(22) Filed: Sep. 4, 2020

(65) Prior Publication Data

US 2021/0071404 A1 Mar. 11, 2021

Related U.S. Application Data

(60) Provisional application No. 62/896,995, filed on Sep. 6, 2019.

(51) Int. Cl.

| | |
|---|---|
| ***E03F 5/06*** | (2006.01) |
| ***E03F 5/04*** | (2006.01) |
| ***E03C 1/26*** | (2006.01) |
| ***A47K 3/40*** | (2006.01) |

(52) U.S. Cl.

CPC ..... *E03F 5/06* (2013.01); *A47K 3/40* (2013.01); *E03C 1/26* (2013.01); *E03F 5/0408* (2013.01); *E03F 2005/063* (2013.01)

(58) Field of Classification Search

CPC ..... E03F 5/0407; E03F 5/0408; E03F 5/06; E03F 2005/063; E03C 1/22; E03C 1/26; A47K 3/283; A47K 3/40

USPC ..... 210/163, 164; 4/613, 679, 286, 292

See application file for complete search history.

(56) References Cited

U.S. PATENT DOCUMENTS

| | | | | |
|---|---|---|---|---|
| 386,768 | A * | 7/1888 | Burrows | E06B 9/02 210/164 |
| 2,025,814 | A * | 12/1935 | Goss | A47K 3/40 4/613 |
| 2,119,923 | A * | 6/1938 | McIntyre | E03F 5/08 210/164 |
| 4,257,892 | A * | 3/1981 | Boersma | E03F 5/0407 210/163 |
| 6,802,962 | B1 * | 10/2004 | Browne, III | E03F 5/06 4/292 |
| 8,496,811 | B2 * | 7/2013 | Cohen | E03C 1/264 210/163 |
| 9,139,996 | B2 * | 9/2015 | Cohen | E03F 5/0407 |
| 10,184,239 | B2 * | 1/2019 | Meincke | E03F 5/06 |
| 2006/0283792 | A1 * | 12/2006 | McCallum | E03F 5/0404 210/163 |

(Continued)

FOREIGN PATENT DOCUMENTS

WO WO 2016/133417 * 8/2016

*Primary Examiner* — Christopher Upton

(74) *Attorney, Agent, or Firm* — Eric J. Sosenko; Jonathan P. O'Brien; Honigman LLP

(57) ABSTRACT

A ligature resistant strainer for a drain assembly and connecting to a drain system. The strainer includes a grate and an extension block coupled to the grate. The grate defines a first thickness, and the extension block defines a second thickness that is greater than the first thickness. Portions of the grate cooperate with portions of the extension block to define a plurality of apertures extending through the strainer and inhibiting attachment of a ligature to the strainer.

23 Claims, 4 Drawing Sheets

(56) References Cited

U.S. PATENT DOCUMENTS

| | | | | |
|---|---|---|---|---|
| 2007/0034577 | A1* | 2/2007 | Bayard | E03F 5/06 210/163 |
| 2014/0157514 | A1* | 6/2014 | Cook | E03F 5/0408 4/679 |
| 2020/0291631 | A1* | 9/2020 | Boeltl | E03F 5/0407 |

* cited by examiner

LIGATURE RESISTANT STRAINER AND DRAIN ASSEMBLY

CROSS REFERENCE TO RELATED APPLICATION

This application is a non-provisional patent application claiming priority to provisional patent application No. 62/896,995, filed Sep. 6, 2019, the entire content of which is herein incorporated by reference.

BACKGROUND

Field of the Invention

The present invention generally relates to floor and shower drains. More specifically, the invention relates to ligature resistant floor and shower drains.

Description of Related Art

Residential institutions, and in particular involuntary residential institutions such as mental health institutions and correctional institutions, have an ongoing concern regarding suicide and attempted suicide by institutionalized persons. Statistics show that the rate of suicide by institutionalized persons greatly exceeds the national averages and that approximately 75% of these suicides occur in a bathroom, bedroom or closet. While the methods of suicide are varied, a high frequency of suicide occurs as a result of asphyxiation through use of a ligature fastened to an object in one of the aforementioned locations.

In the interest of the well-being of the institutionalized persons, residential institutions are desirous of incorporating fixtures within their facilities that discourage the formation of an attachment or anchor point for a ligature. Such structures and devices are typically referred to as being ligature resistant.

To prevent a fixture from being used as an anchor point for a ligature, at least two general strategies are employed. According to one strategy, the intent of the fixture design is to not allow for a ligature to be pulled upon while the ligature is wrapped around the fixture. Rather, when a ligature is wrapped around a portion of the fixture, any pulling force applied to the ligature, in substantially any direction, will cause the ligature to pull or slip off of the fixture. In another strategy, the design of the fixture is such that it is very difficult to manipulate the ligature such that it may be looped or threaded about the fixture. Ligature resistant floor and shower drains typically employ this second strategy.

Floor and shower drains typically have holes or slots that can be used to attach a ligature (such as a string, cord, rope or wire) by looping the ligature through one hole or slot, under the bridge or web between the adjacent hole or slot, and then back out of the adjacent hole or slot. Once tied, an anchor or ligature point is created.

While it may be impossible to completely eliminate all resident suicides that employ a ligature, it is desirous to incorporate fixtures and structures within residential institutions, and in particular involuntary residential institutions that inhibit and discourage the formation of a ligature point.

SUMMARY

In satisfying the above need, as well as overcoming the enumerated drawbacks and other limitations of the related art, in one aspect of the present invention a ligature resistant strainer for a drain is provided.

In another aspect, the ligature resistant strainer includes a grate having a first thickness. An extension block is coupled to the grate, and the extension block defines a second thickness that is greater than the first thickness. Portions of the grate and portions of the extension block cooperate to define a plurality of apertures that extend through both the first and second thickness of the grate and the extension block.

In a further aspect, the grate and the extension block are individual components mounted to one another forming an integral component.

In an additional aspect, the grate and the extension block are unitarily formed.

In yet another aspect, the second thickness is in the range of four to 10 times greater than the first thickness.

In still a further aspect, the extension block includes a radially facing perimeter wall.

In an additional aspect, the perimeter wall includes a recess defined therein.

In another aspect, the strainer includes a retainer mechanism at least partially located within the recess, and which includes a member moveable between a radially inward position and a radially outward position.

In yet a further aspect, the member has an eccentric shape about an axis of rotation of the member.

In another aspect of the invention, a ligature resistant drain assembly for connecting to a drain system is provided that includes a drain body having outlet coupling adapted for connecting to the drain system; a strainer coupled to the drain body, the strainer including a grate having a first thickness, portions of the grate defining a plurality of apertures extending through the grate, the strainer further including an extension block extending from the grate and having a second thickness, the second thickness being greater than the first thickness, the extension block including portions defining a plurality of apertures extending through the extension block, the apertures of the extension block corresponding to the apertures of the strainer and defining cooperatively defining extended apertures extending through the strainer.

In another aspect, the grate and the extension block are one of individual components connected to each another or a one-piece construction.

In a further aspect, a retaining feature is included that retainingly engages the strainer with the drain body, the retaining feature including a member moveable between a radially inward position and a radially outward position, in the radially outward position the member engaging the drain body.

In an additional aspect, the retaining feature includes a groove defined in the drain body and in which the member is received in the radially outward position.

In yet another aspect, the groove is a circumferential groove extending at least partly about the drain body.

In a further aspect, the extension block includes a radially facing perimeter wall including a recess defined therein.

In still an additional aspect, the retaining feature is at least partially located within the recess.

In another aspect, the member has an eccentric shape about an axis of rotation of the member.

In yet a further aspect, the second thickness is in the range of four to 10 times greater than the first thickness.

In another aspect of the invention, a ligature resistant shower pan assembly for connecting to a drain system is provided and includes a shower pan defining a basin, portions of the basin defining a drain opening extending through the basin; a drain body having outlet coupling configured to connect to the drain system; a collar attached to the drain body and cooperating with the drain body to engage the shower pan between the collar and the drain body; a strainer coupled to the drain body and including a grate and an extension block extending from the grate, the grate having a first thickness and an extension block having a second thickness, the second thickness, the second thickness being greater than the first thickness, portions of the grate and portions of the extension block cooperatively defining a plurality of apertures extending through the strainer, the grate and the extension block being one of individual components connected to each another or a one-piece construction; and a retaining feature configured to retainingly engage the strainer with the drain body, the retaining feature including a member moveable between a radially inward position and a radially outward position, in the radially outward position the member engaging the drain body.

In a further aspect, the second thickness is in the range of four to 10 times greater than the first thickness.

In an additional aspect, a retaining feature is provided which retainingly engages the strainer with the drain body. The retaining feature includes a circumferential groove defined in the drain body and a member moveable between a radially inward position and a radially outward position. In the radially outward position, the member engages the drain body in the groove. The member of the retaining feature is located in a recess defined in a radially facing perimeter wall of the extension block.

Further objects, features and advantages of this invention will become readily apparent to persons skilled in the art after review of the following description, including the claims, and with reference to the drawings that are appended to and form a part of this specification.

DETAILED DESCRIPTION

As used in the description that follows, directional terms such as "upper" and "lower" are used with reference to the orientation of the elements as presented in the figures. Accordingly, "upper" indicates a direction toward the top of the figure and "lower" indicates a direction toward the bottom of the figure. The terms "left" and "right" are similarly interpreted. The terms "inward" or "inner" and "outward" or "outer" indicate a direction that is generally toward or away from a central axis of the referred to part whether or not such an access is designated in the figures. An axial surface is therefore one that faces in the axial direction. In other words, an axial surface faces in a direction along the central axis. A radial surface therefore faces radially, generally away from or toward the central axis. It will be understood, however, that in actual implementation, the directional references used herein may not necessarily correspond with the installation and orientation of the corresponding components or device.

Figure 1:
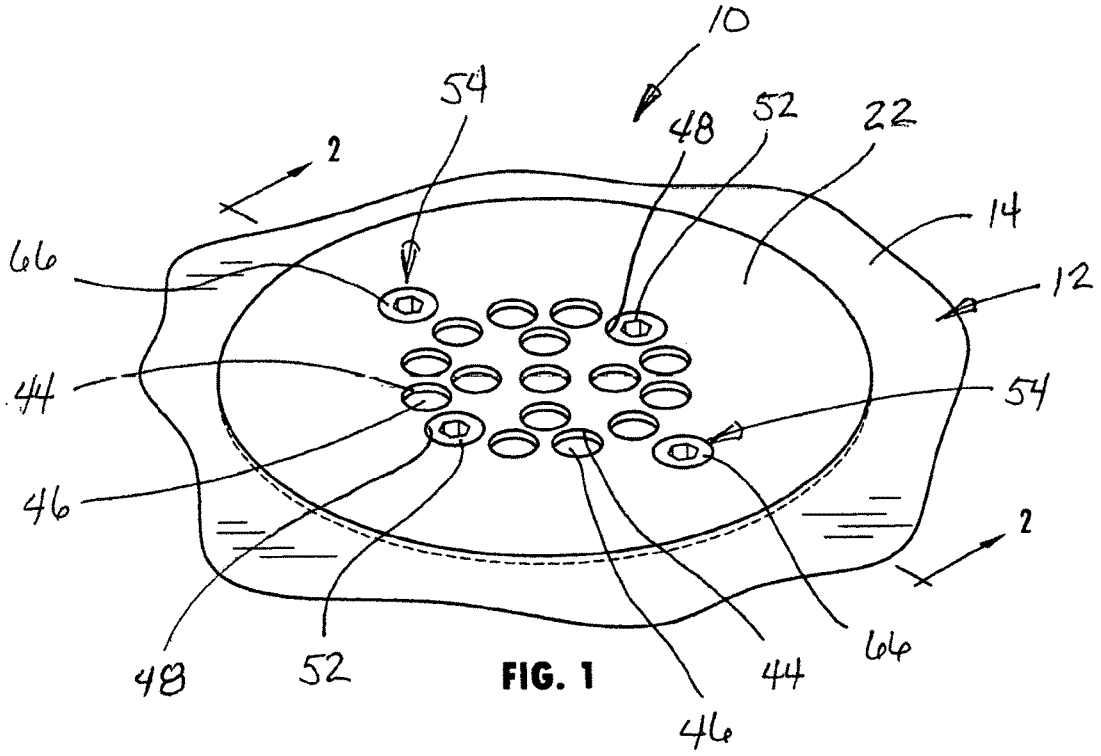
FIG. 1 is a perspective view of a drain, installed in a floor or shower pan, embodying the principles of the present invention.
Figure 2:
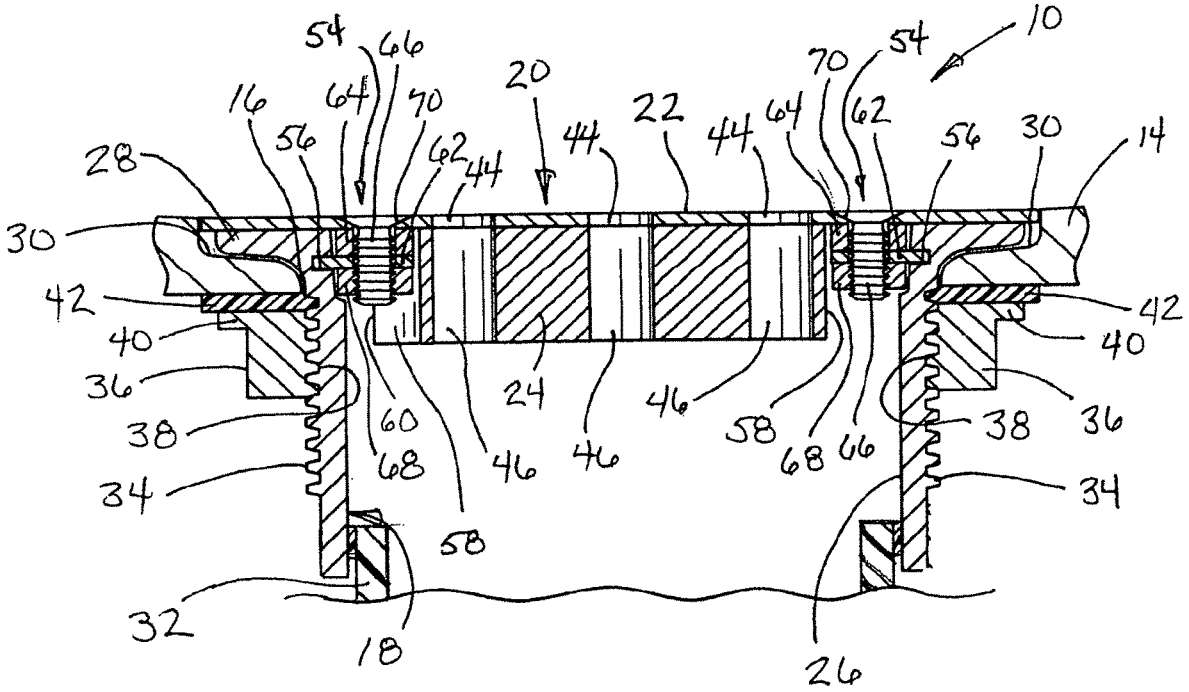
FIG. 2 is a cross-sectional view, generally taken along line 2-2, of the drain seen in FIG. 1.

Referring now to the drawings, a drain embodying the principles of the present invention is generally seen in FIG. 1 and designated at 10. As seen in FIGS. 1 and 2, the drain 10 is installed in a basin 14 of a shower pan 12. More specifically, the drain 10 may be installed in a drain opening 16 defined by portions of the basin 14 of the shower pan 12 or, alternatively, in a floor.

The drain 10 includes, as its principal components, a drain body 18 and a strainer 20, the latter of which further includes a strainer grate 22 and a strainer block extension 24. In one aspect, the present invention may be viewed as including both the drain body 18 and strainer 20. In another aspect, the invention may be viewed as including just the strainer 20.

Referring now to FIG. 2, as seen therein, the drain body 18 includes a cylindrical outlet coupling 26 that axially extends from a radial flange 28. As shown, the flange 28 is annular and is shaped to be received within a recess portion 30, which may also be annular, formed in the basin 14 and defining the drain opening 16. While shown as being annular, the flange 28 may have different shapes, e.g. rectangular, The outlet coupling 26 is inwardly or centrally located with respect to the flange 28 so as to extend through the drain opening 16, and the opposing end of the outlet coupling 26 is intended to be received in (not shown) or over (as illustrated) the open end of a drain pipe 32 that is part of the drain system of the building/installation site.

Over a portion of its surface, beginning generally adjacent to flange 28, the outlet coupling 26 is provided with external threads 34. The external threads 34 permit engagement of a collar 36, having corresponding internal threads 38, with the drain body 18. By threading the collar 36 toward the flange 28, the recess portion 30 of the basin 14 can be clamped and secured between the flange 28 of drain body 18 and a corresponding flange 40 of the collar 36. Between the flange 28 of the drain body 18 and the flange 40 of the collar 36, a gasket 42 may be employed about the drain body 18 to form a fluid tight seal between the drain 10 and the shower pan 12.

As mentioned above, the strainer 20 includes the strainer grate 22 and the strainer block extension 24. The strainer grate 22 is a plate-like structure having a thickness of approximately $1/16^{th}$ to approximately $1/8^{th}$ of an inch (although other thicknesses may be employed) and whose perimeter is shaped to generally correspond with the shape of the perimeter of the recessed portion 30 of the shower pan 12, as noted above. Accordingly, when the drain 10 is fully installed in the shower pan 12, the top surface of the strainer grate 22 is flush with the top surface of the basin 14 and the perimeter of the strainer grate 22 generally corresponds with the perimeter of the recessed portion 30.

The center region of the strainer grate 22 is provided with a plurality of apertures 44 that extend completely through the thickness of the strainer grate 22. The apertures 44 allow water collected in the basin 14 to pass from the shower pan 12 into the drain body 18, where it is directed into the drain pipe 32 of the building's drain system. Preferably, the diameter of the apertures is about $5/16^{ths}$ of an inch, but other sized diameters may be employed.

The strainer block extension 24 is a block-like structure attached to the lower surface of the strainer grate 22. The strainer block extension 24 has an effective diameter that permits it to be received within the drain body 18 when the strainer 22 is mounted to the drain body 18. The thickness of the strainer block extension 24 is substantially greater than the thickness of the strainer grate 22. Preferably, the thickness of the strainer block extension 24 is greater than ½ inch and more preferably at least $\frac{5}{8}^{ths}$ of an inch in thickness. As such, the strainer block extension 24 may have a thickness that is 4 times to 10 times as thick as the strainer grate 22.

To integrally secure the strainer block extension 24 to the strainer grate 22, two tapered bores 48 are provided in the strainer grate 22 and two correspondingly positioned threaded bores 50 are provided in the strainer block extension 24. Tamper resistant threaded fasteners 52, such as flat Allen screws or flat socket cap head screws, are inserted through the tapered bores 48 and threaded into engagement with the threaded bores 50 of the strainer block extension 24. The length of the fasteners 52 is such that the flat, top surfaces of the heads of the fasteners 52 are flush with the top surface of the strainer grate 22, as seen in FIG. 1.

Figure 4:
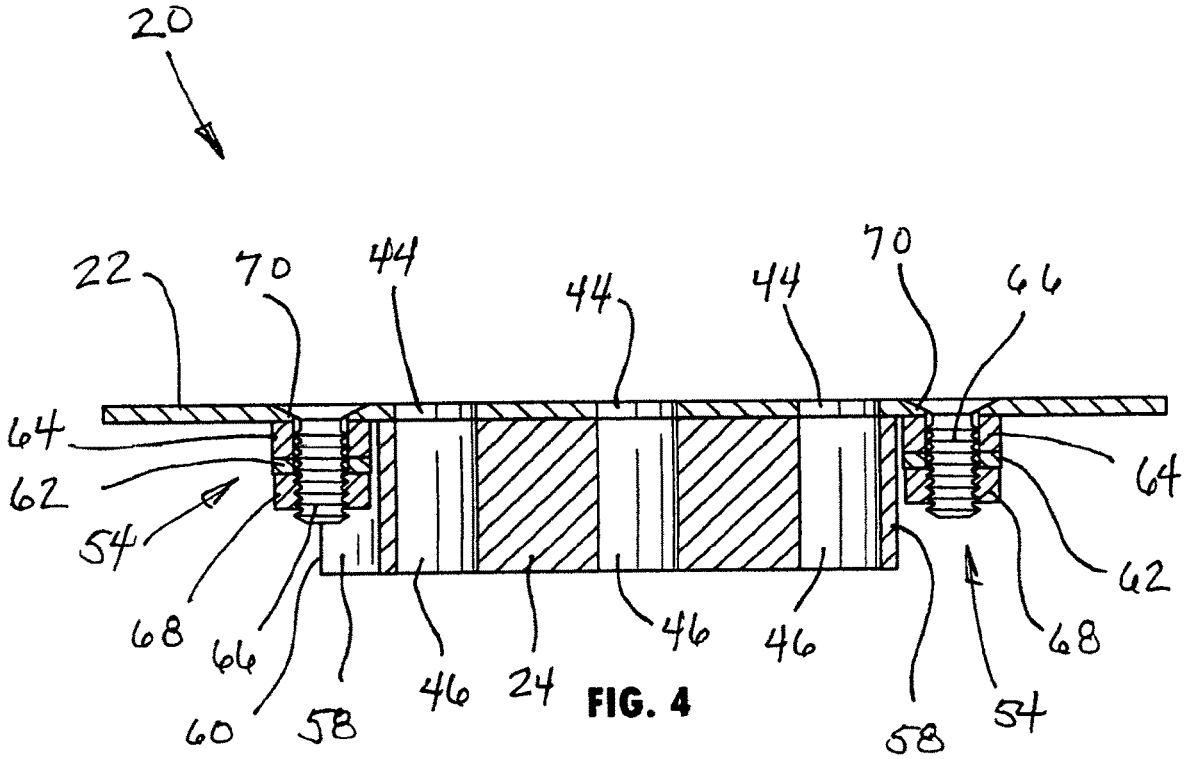
FIG. 4 is an assembled, cross-sectional view of the strainer assembly of the drain.
Figure 5:
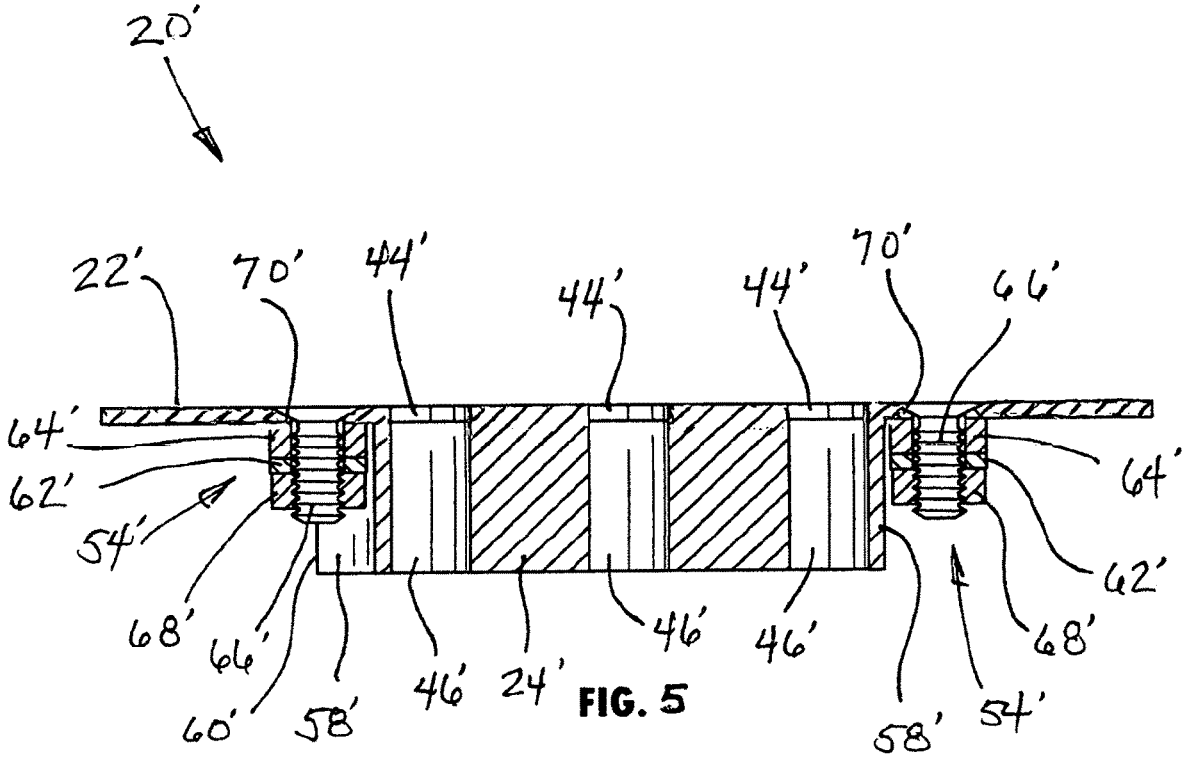
FIG. 5 is a cross-sectional view of a strainer assembly according to a further embodiment incorporating the principles of the present invention.

In an alternative construction, seen in FIG. 5, the strainer grate 22' and strainer block extension 24' are unitarily constructed, thereby forming a one-piece strainer 20'. The elements and features of the strainer 20' seen in FIG. 5 correspond with the elements and features seen in the strainer 20 of FIG. 4 and, accordingly, bear corresponding reference numerals and a prime (') designation.

The strainer block extension 24 is provided with a plurality of apertures 46 that preferably correspond in number, position and diameter with the apertures 44 provided in the strainer grate 22. Accordingly, when the strainer block extension 24 is attached to the strainer grate 22, the apertures 46 of the strainer block extension 24 align with the apertures 44 of the strainer grate 22 and cooperate therewith to effectively form extensions of the apertures 44 of the strainer grate 22. The combined length of the apertures 44 of the strainer grate 22 and the apertures 46 of the strainer block extension 24, which is preferably ½ inch or greater and more preferably $\frac{11}{16}^{ths}$ of an inch or greater. This thickness, as well as in cooperation with the diameter of the combined apertures, effectively impedes the ability of an individual to thread a ligature down one combined aperture and back up another combined aperture so as to form an anchor point for the ligature.

To removably secure the strainer 22 to the drain body 18, a pair of retainer mechanisms 54 are provided on the strainer 22. The retainer mechanisms 54 cooperate with a circumferential groove 56 (seen in FIG. 2) formed in an interior wall or surface of the drain body 18, generally inwardly of the flange 28. The circumferential groove 56 may extend completely or only partially around the drain body 18. As shown, the groove 56 extends completely around the drain body 18.

Figure 3:
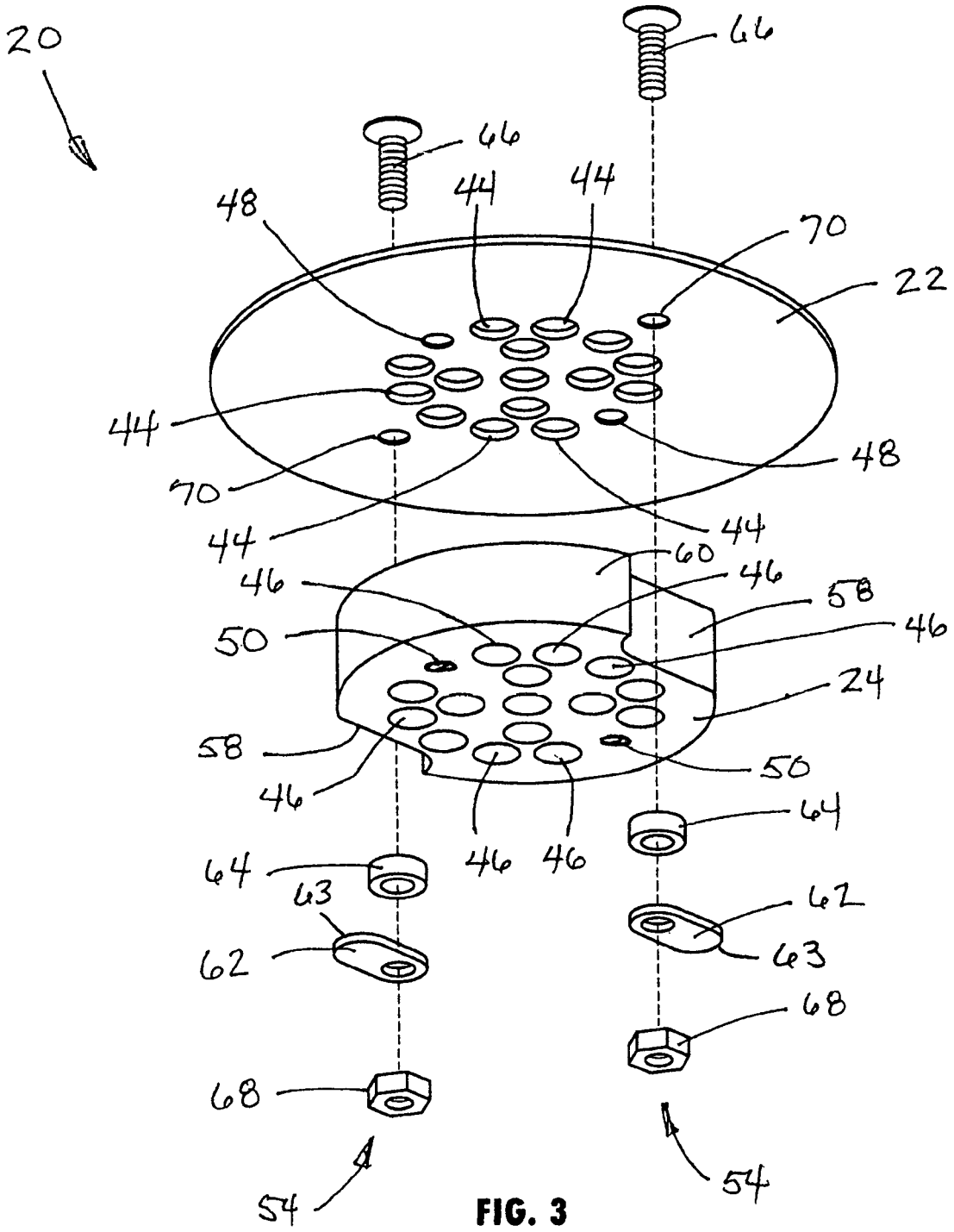
FIG. 3 is an exploded view of the strainer assembly of the drain seen in FIGS. 1 and 2, generally viewed from the bottom.

At least a portion of the retainer mechanism 54 is rotatably secured to the strainer 20 and is positioned in cutouts or recesses 58 formed in the perimeter wall 60 of the strainer block extension 24. As shown in FIG. 3, the cutouts 58 define J-shaped recesses, when viewed axially, in the perimeter wall 60, which is otherwise round (preferably) in shape.

Within the cutouts 58, the retainer mechanism 54 includes a rotatable, eccentric washer or clip 62. The washer 62 is spaced apart from the bottom surface of the strainer grate 22 by a bushing 64 and secured by a mechanical fastener, such as a bolt 66 extended through the washer 62 and bushing 64 and engaged by a lock nut 68. Prior to passing through the bushing 64 and washer 62, the bolt 66 is extended through a tapered bore 70 in the strainer grate 22 such that the top surface of the bolt 66 is flush with the top surface of the strainer grate 22, similar to fasteners 52 mentioned above. The washer 62 and nut 68 are threaded to engage the bolt 66 and, once engaged properly positioned, fixedly secured so that they, the washer 62 and nut 68, will rotate when the bolt 66 is rotated. This fixed securement may be achieved through use of a thread-locking adhesive or other mechanism that prevents relative rotation between these components.

When the drain body 18 is secured to the shower pan 12 by the collar 36, the upper surface of the flange 28 of the drain body 18 is recessed relative to the upper surface defining the basin 14. The strainer 20 is thereafter positioned with the strainer block extension 24 radially inward of the flange 28 in the center of the opening defined by the drain body 18 and with the lower surface of the strainer grate 22 overlying the upper surface of the flange 28. When properly installed, the upper surface of the strainer grate 22 is generally flush with the upper surface of the basin 14. By rotating the bolt 66, which may also incorporate tamper resistant design, such as a flat Allen head, the washer 62 can be caused to simultaneously rotate. The washer 62 may have an elongate shape with the bolt 66 passing through one end of the elongated structure of the washer 62. Accordingly, the washer 62 is eccentric about the bolt 66. Accordingly, when the washer 62 is rotated, a free end 63 of the washer 62 can be caused to rotate from a radially inward position to a radially outward position, out of the cutout 58 in the strainer block extension 24. The thickness of the bushing 64 is selected such that the position of the washer 62 corresponds to the position of the groove 56. When rotated into the radially outward position, the free end 63 of the washer 62 is received in, and engaged with, the groove 56 of the drain body 18. Retained in the groove 56, the washer 62 prevents the strainer 20 from being withdrawn or removed from the drain body 18.

The above description is meant to be illustrative of at least one preferred implementation incorporating the principles of the invention. One skilled in the art will really appreciate that the invention is susceptible to modification, variation and change without departing from the true spirit and fair scope of the invention, as defined in the claims that follow. The terminology used herein is therefore intended to be understood in the nature of words of description and not words of limitation.

I claim:

1. A ligature resistant strainer for a drain assembly and connecting to a drain system, the strainer comprising:

a grate, the grate defining a first thickness;

an extension block coupled to the grate, the extension block defining a second thickness, the second thickness being greater than the first thickness;

portions of the grate and portions of the extension block cooperating to define a plurality of apertures, the plurality of apertures extending through both the first thickness of the grate and the second thickness of the extension block; and a retainer mechanism configured to retainingly engage the strainer in the drain assembly, the retainer mechanism being supported by the grate and independent of the extension block.

2. The ligature resistant strainer according to claim 1, wherein the grate and the extension block are individual components mounted to one another forming an integral component.

3. The ligature resistant strainer according to claim 1, wherein the grate and the extension block are unitarily formed.

4. The ligature resistant strainer according to claim 1, wherein the second thickness is in the range of four to 10 times greater than the first thickness.

5. The ligature resistant strainer according to claim 1, wherein the extension block includes a radially facing perimeter wall.

6. The ligature resistant strainer according to claim 5, wherein the perimeter wall includes a recess defined therein.

7. The ligature resistant strainer according to claim 6, wherein the retainer mechanism is positioned adjacent to the recess and includes a member moveable between a radially inward position and a radially outward position.

8. The ligature resistant strainer according to claim 7, wherein the member has an eccentric shape about an axis of rotation of the member.

9. A ligature resistant drain assembly for connecting to a drain system, the drain assembly comprising:

a drain body having outlet coupling adapted for connecting to the drain system; and a strainer coupled to the drain body, the strainer including a grate having a first thickness, portions of the grate defining a plurality of apertures extending through the grate, the strainer further including an extension block extending from the grate and having a second thickness, the second thickness being greater than the first thickness, the extension block including portions defining a plurality of apertures extending through the extension block, the apertures of the extension block corresponding to the apertures of the strainer and defining cooperatively defining extended apertures extending through the strainer, and a retainer mechanism configured to retainingly engage the strainer in the drain body, the retainer mechanism being supported by the grate and independent of the extension block.

10. The ligature resistant drain assembly according to claim 9, wherein the apertures are all located radially inward of the retainer mechanism.

11. The ligature resistant drain assembly of claim 10, wherein the grate and the extension block are one of individual components connected to each another or a one-piece construction.

12. The ligature resistant drain assembly of claim 10, wherein the retainer mechanism includes a member moveable between a radially inward position and a radially outward position, in the radially outward position the member engaging the drain body.

13. The ligature resistant drain assembly of claim 12, wherein the retainer mechanism includes a groove defined in the drain body, the member being received in the groove in the radially outward position of the member.

14. The ligature resistant drain assembly of claim 13, wherein the groove is a circumferential groove extending at least partly about the drain body.

15. The ligature resistant drain assembly of claim 13, wherein the extension block includes a radially facing perimeter wall including a recess defined therein.

16. The ligature resistant drain assembly according to claim 15, wherein the retainer mechanism is located adjacent to the recess.

17. The ligature resistant drain assembly according to claim 12, wherein the member has an eccentric shape about an axis of rotation of the member.

18. The ligature resistant drain assembly of claim 10, wherein the second thickness is in the range of four to 10 times greater than the first thickness.

19. The ligature resistant strainer according to claim 1, wherein the apertures are all located radially inward of the retainer mechanism.

20. A ligature resistant shower pan assembly for connecting to a drain system, the shower pan assembly comprising:

a shower pan defining a basin, portions of the basin defining a drain opening extending through the basin;

a drain body having outlet coupling configured to connect to the drain system;

a collar attached to the drain body and cooperating with the drain body to engage the shower pan between the collar and the drain body;

a strainer coupled to the drain body and including a grate and an extension block extending from the grate, the grate having a first thickness and an extension block having a second thickness, the second thickness, the second thickness being greater than the first thickness, portions of the grate and portions of the extension block cooperatively defining a plurality of apertures extending through the strainer, the grate and the extension block being one of individual components connected to each another or a one-piece construction; and a retainer mechanism supported by the grate and being independent of the extension block, the retainer mechanism being configured to retainingly engage the strainer with the drain body, the retainer mechanism including a member moveable between a radially inward position and a radially outward position, in the radially outward position the member engaging the drain body.

21. The ligature resistant shower pan assembly according to claim 20, wherein the second thickness is in the range of four to 10 times greater than the first thickness.

22. The ligature resistant shower pan assembly according to claim 20, wherein the retainer mechanism includes a circumferential groove defined in the drain body, in the radially outward position the member engaging the drain body in the groove.

23. The ligature resistant shower pan assembly according to claim 20, wherein the apertures are all located radially inward of the retainer mechanism.

* * * * *